US005615805A

United States Patent [19]

Yoncak

[11] Patent Number: 5,615,805

[45] Date of Patent: Apr. 1, 1997

[54] CAULK CONTAINER WITH HEATER COILS

[76] Inventor: Alexander T. Yoncak, 358 Liberty St., Old Bridge, N.J. 08857

[21] Appl. No.: 440,671

[22] Filed: May 15, 1995

[51] Int. Cl.[6] ..... B67D 5/62

[52] U.S. Cl. ..... 222/146.5; 222/183; 219/521; 219/535

[58] Field of Search ..... 222/146.5, 183, 222/325, 321, 327; 219/521, 535

[56] References Cited

U.S. PATENT DOCUMENTS

| | | | |
|---|---|---|---|
| 4,065,034 | 12/1977 | Callan | 222/146.5 |
| 4,067,481 | 1/1978 | Feldman | 222/146.5 |
| 4,155,002 | 5/1979 | Cohen | 219/535 |
| 4,279,255 | 7/1981 | Hoffman | 219/535 |
| 5,040,700 | 8/1991 | Compton | 222/146.5 |
| 5,436,429 | 7/1995 | Cline | 219/535 |

*Primary Examiner*—Philippe Derakshani

[57] ABSTRACT

A caulk container with heater coils comprising: a thermal sleeve formed in a generally cylindrical configuration with an inboard region and an outboard region, the sleeve being formed of heat-resistent material, the sleeve including a plurality of heater coils operatively coupled to each other, the outboard region having an end including an aperture to permit the passage of a dispensing tip of a tube of caulking material therethrough, the inboard region of the sleeve including coupling means to permit insertion of a tube of caulking material therein, the sleeve including a power source to cause thermal heating of the heater coils of the apparatus.

2 Claims, 3 Drawing Sheets

CAULK CONTAINER WITH HEATER COILS

BACKGROUND OF THE INVENTION

1. Field of the Invention

The present invention relates to a caulk container with heater coils and more particularly pertains to placing the container around a tube of caulking material in order to maintain proper consistency in cold weather.

2. Description of the Prior Art

The use of thermal devices is known in the prior art. More specifically, thermal devices heretofore devised and utilized for the purpose of heating various items positioned in proximity to the thermal device are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 3,569,666 to Murphy a self contained low voltage battery operated glove.

U.S. Pat. No. 4,706,852 to Borst discloses a inlet sleeve for hot-melt dispensers.

U.S. Pat. No. 4,974,752 to Sirek discloses a heated caulk dispensing gun.

Lastly, U.S. Pat. No. 5,230,333 to Yates discloses a thermal sock having a toe heating pocket.

In this respect, the caulk container with heater coils according to the present invention substantially departs from the conventional concepts and designs of the prior art, and in doing so provides an apparatus primarily developed for the purpose of placing the container around a tube of caulking material in order to maintain proper consistency in cold weather.

Therefore, it can be appreciated that there exists a continuing need for a new and improved caulk container with heater coils which can be used for placing the container around a tube of caulking material in order to maintain proper consistency in cold weather. In this regard, the present invention substantially fulfills this need.

SUMMARY OF THE INVENTION

In view of the foregoing disadvantages inherent in the known types of thermal devices now present in the prior art, the present invention provides an improved caulk container with heater coils. As such, the general purpose of the present invention, which will be described subsequently in greater detail, is to provide a new and improved caulk container with heater coils and method which has all the advantages of the prior art and none of the disadvantages.

To attain this, the present invention essentially comprises a tube of caulking material formed in a generally cylindrical configuration with an inboard end and an outboard end, the outboard end including a conical shaped dispensing tip having an axial aperture, the tube permitting a user to squeeze it thereby expelling caulking material through the dispensing tip and onto a desired surface; a thermal sleeve formed in a generally cylindrical configuration with an inboard region and an outboard region, the outboard region including an end with an aperture, the sleeve being formed of heat resistent semi-rigid materials, the outboard region including a plurality of circular heater coils formed contiguously with each other, the inboard region including a plurality of heater coil loops formed in a semi-circular offset arrangement, the heater coil loops being operatively coupled to the circular heater coils, an opening being defined between the loops, the opening including VELCRO coupling means and a linear slit to permit a user to open the inboard end of the sleeve and insert a tube of caulking material therein, the tube of caulking material being securely positioned within the sleeve with its dispensing tip extending through the aperture in the outboard end of the sleeve; a battery pack formed as a generally rectangular shaped box, the batter pack including an upper surface containing a lid to permit removal and placement of at least one battery therein, the battery pack also including a pair of male prong members and battery terminals, the male prong members and battery terminals being operatively coupled to the circular heater coils and heater coil loops of the apparatus; and an extension cord having two free ends, a first end including a female plug affixed thereto, the female plug adapted to mate with the male prong members of the battery pack in an operative orientation, a second end including a male plug affixed thereto, the male plug adapted to be positioned in a standard ground electrical outlet in an operative orientation, the cord permitting the flow of a source of potential to the apparatus when coupled to an electrical outlet, the batteries supplying a source of electrical potential to the apparatus when utilizing it in a location distant from an electrical outlet, in an operative orientation the circular heater coils and heater coil loops serving to heat a tube of caulking material in order to maintain proper consistency in cold weather conditions.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved caulk container with heater coils which has all of the advantages of the prior art thermal devices and none of the disadvantages.

It is another object of the present invention to provide a new and improved caulk container with heater coils which may be easily and efficiently manufactured and marketed.

It is further object of the present invention to provide a new and improved caulk container with heater coils which is of durable and reliable constructions.

An even further object of the present invention is to provide a new and improved caulk container with heater coils which is susceptible of a low cost of manufacture with regard to both materials and labor, and which accordingly is then susceptible of low prices of sale to the consuming public, thereby making such caulk container with heater coils economically available to the buying public.

Still yet another object of the present invention is to provide a new and improved caulk container with heater coils which provides in the apparatuses and methods of the prior art some of the advantages thereof, while simultaneously overcoming some of the disadvantages normally associated therewith.

Still another object of the present invention is to place the container around a tube of caulking material in order to maintain proper consistency in cold weather.

Lastly, it is an object of the present invention to provide a new and improved caulk container with heater coils comprising: a thermal sleeve formed in a generally cylindrical configuration with an inboard region and an outboard region, the sleeve being formed of heat-resistent material, the sleeve including a plurality of heater coils operatively coupled to each other, the outboard region having an end including an aperture to permit the passage of a dispensing tip of a tube of caulking material therethrough, the inboard region of the sleeve including coupling means to permit insertion of a tube of caulking material therein, the sleeve including a power source to cause thermal heating of the heater coils of the apparatus.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
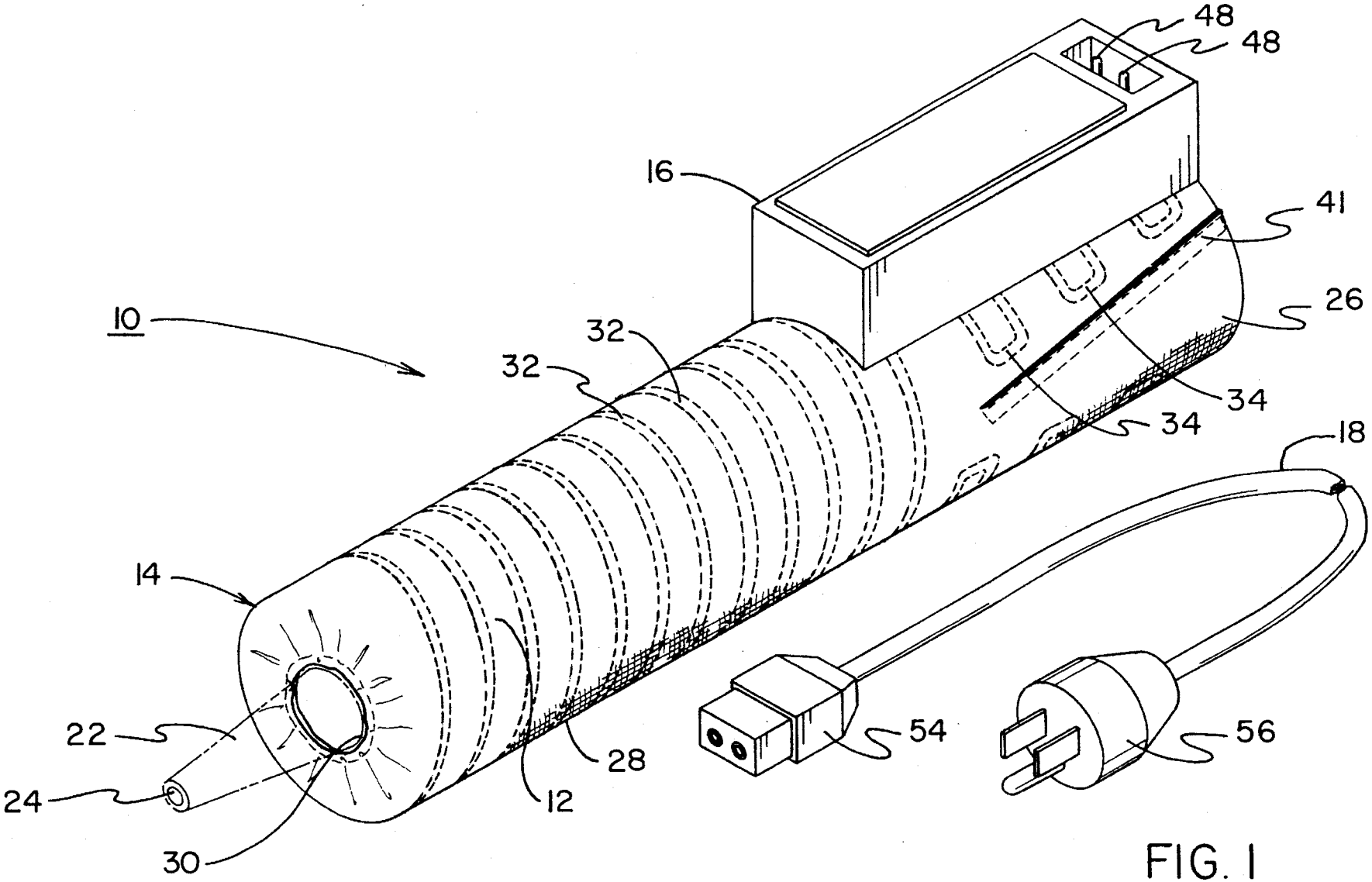
FIG. 1 is a perspective view of the preferred embodiment of the caulk container with heater coils constructed in accordance with the principles of the present invention.

With reference now to the drawings, and in particular to FIG. 1 thereof, the preferred embodiment of the new and improved caulk container with heater coils embodying the principles and concepts of the present invention and generally designated by the reference numeral 10 will be described.

The present invention, the caulk container with heater coils 10 is comprised of a plurality of components. Such components in their broadest context include a dispensing tube 12, a thermal sleeve 14, a battery pack 16 and an extension cord 18. Such components are individually configured and correlated with respect to each other so as to attain the desired objective.

More specifically, the tube of caulking material 12 is formed in a generally cylindrical configuration with an inboard end and an outboard end. The tube contains 1/10 of a gallon of caulking material in the preferred embodiment. In alternative embodiments of the apparatus, the tube contains one quart of caulk. The outboard end includes a conical shaped dispensing tip 22 having an axial aperture 24. The tube permits a user to squeeze it, thereby expelling caulking material through the dispensing tip and onto a desired surface. In warm weather conditions the caulking material has a consistency permitting the user to easily squeeze it through the dispensing tip. However, in cold weather conditions the caulking material hardens and the user is not able to squeeze the material through the dispensing tip. When activated, the various coils of the apparatus heat the caulking material to provide a consistency which permits the user to squeeze it through the dispensing tip and onto a desired surface. Note FIG. 1.

Figure 2:
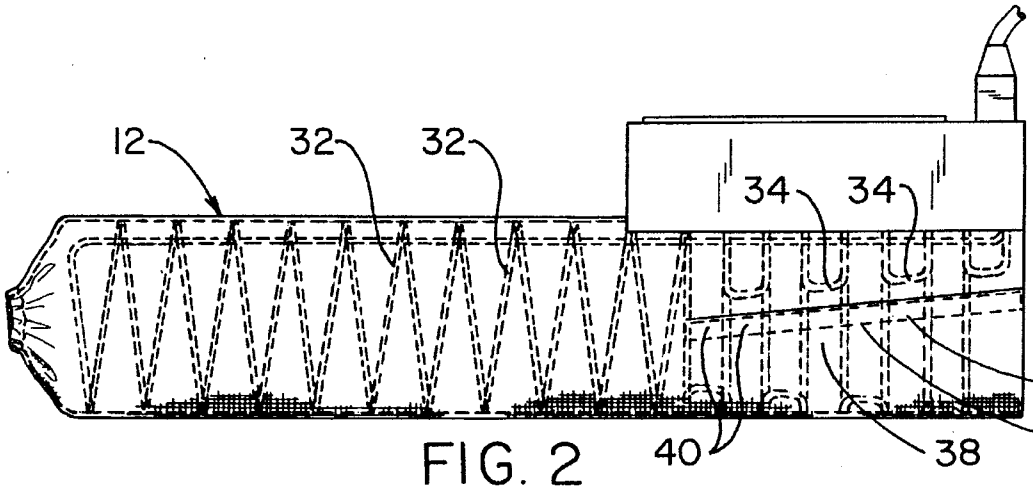
FIG. 2 is side perspective view of the apparatus shown in FIG. 1 illustrating the battery pack and male plug of the apparatus.
Figure 3:
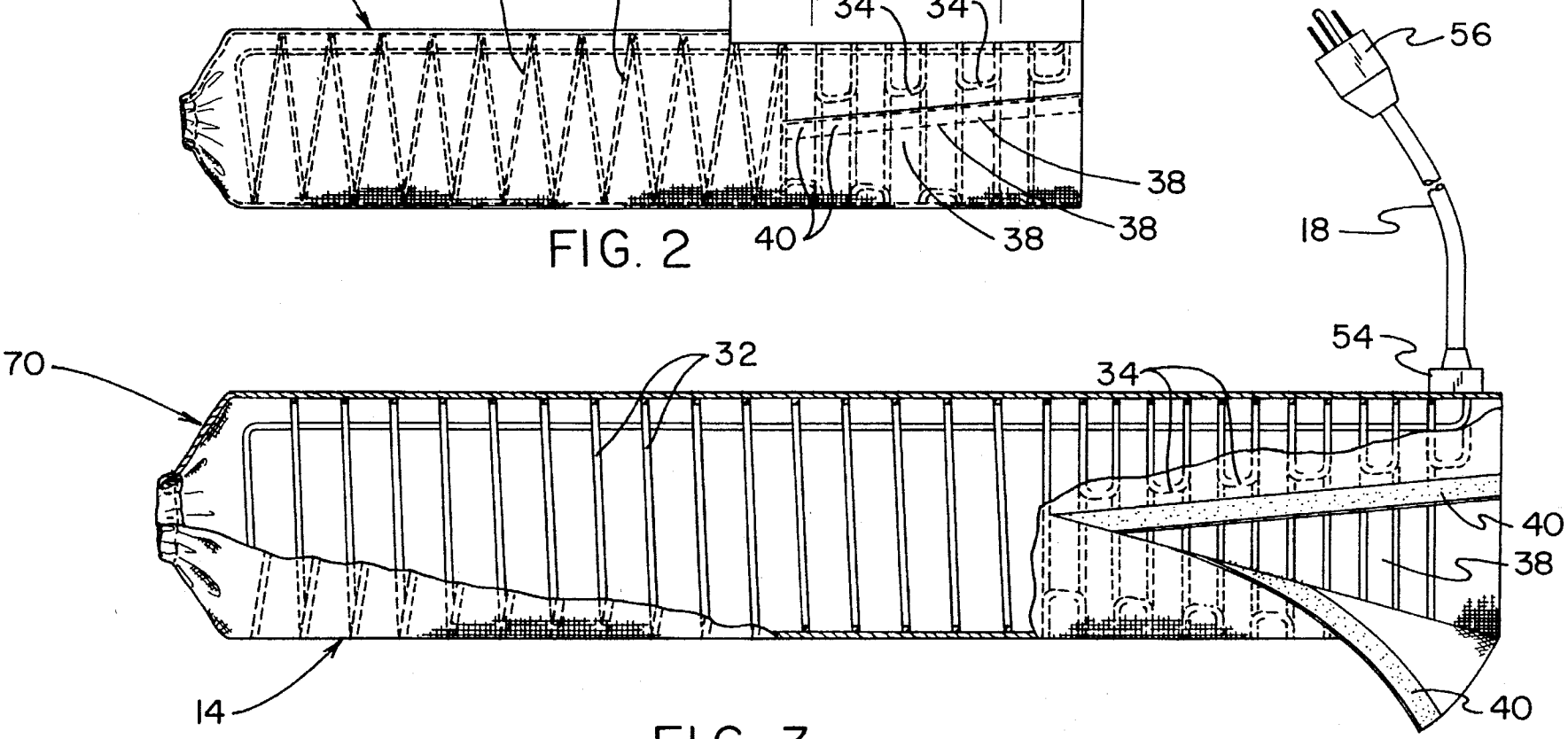
FIG. 3 is a side perspective illustration of an alternative embodiment of the apparatus.

A thermal sleeve 14 is formed in a generally cylindrical configuration with an inboard region 26 and an outboard region 28. In the preferred embodiment the sleeve is about ten inches long and has a diameter of about two inches. The primary embodiment is adapted to retain a one-tenth of a gallon size tube of caulking material within it. In a first alternative embodiment 70 the sleeve is about fifteen inches long and has a diameter of about two and seven-eighths inches. The alternative embodiment 70 is adapted to retain a quart size tube of caulking material within it. Note FIGS. 1–3.

The outboard region includes an end with an aperture. The sleeve is formed of heat resistent semi-rigid materials. In one embodiment of the apparatus the inner surface of the sleeve includes a metal based material to more effectively distribute heat. The sturdy construction of the sleeve prevents tearing and breaking when utilized under harsh conditions. The outboard region includes a plurality of circular heater coils 32 formed contiguously with each other. The coils are formed of sturdy heat-conductive metal. Note FIG. 2.

The inboard region includes a plurality of heater coil loops 34 formed in a semi-circular offset arrangement. The heater coil loops are formed of the same material as the circular heater coils but are not positioned around the entire circumference of the inboard section. The heater coil loops 34 are operatively coupled to the circular heater coils 32. An opening 38 sufficiently large to permit passage of a tube of caulking material is defined between the loops. The opening includes VELCRO coupling means 40 and a linear slit 41 to permit a user to open the inboard end of the sleeve and insert a tube of caulking material in it. The tube of caulking material is securely positioned within the sleeve with its dispensing tip extending through the aperture in the outboard end of the sleeve. In an operative orientation the coils heat the outer covering of the dispensing tube thereby heating the caulking material to permit dispensing through the tip of the tube. Note FIGS. 1 and 2.

Figure 4:
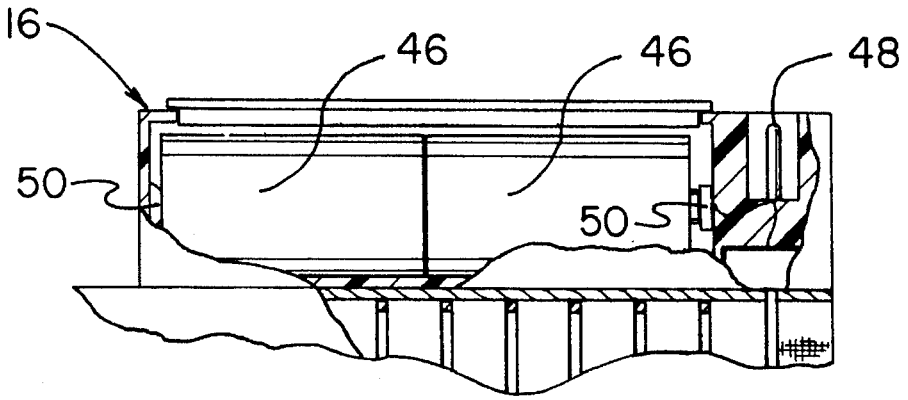
FIG. 4 is a cross sectional view of the battery pack shown in FIG. 1.

A battery pack 16 is formed as a generally rectangular shaped box. The batter pack includes an upper surface containing a lid to permit removal and placement of at least one battery 46 in it. In the preferred embodiment two batteries are included with the apparatus. The battery pack also includes a pair of male prong members 48 and battery terminals 50. The male prong members and battery terminals are operatively coupled to the circular heater coils and heater coil loops of the apparatus. The battery pack enables the user to heat the apparatus when working in remote areas such as upon a building roof or in an unfinished basement. The preferred embodiment includes both battery pack and male prong members to permit AC or DC powering of the coils. In the first alternative embodiment of the apparatus the sleeve only includes male prong members couplable to an AC power source. Note FIG. 3. Such an alternative embodiment is too large to be powered by batteries alone. Note FIGS. 1 and 4.

Figure 5:
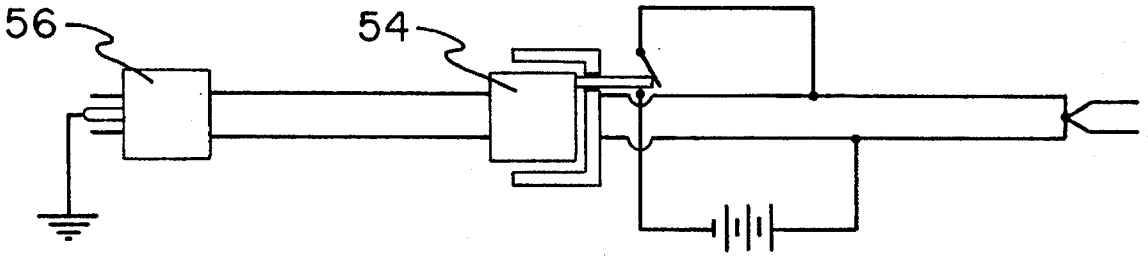
FIG. 5 is a schematic diagram of the power source of the apparatus.

An extension cord 18 has two free ends. A first end includes a female plug 54 affixed to it. The female plug is adapted to mate with the male prong members of the battery pack in an operative orientation. A second end includes a male plug 56 affixed to it. The male plug is adapted to be positioned in a standard ground electrical outlet in an operative orientation. Note FIGS. 1 and 5. Various alternative embodiments of the cord are produced in a plurality of different lengths. The cord may also be coupled to a standard extension cord if required. Note FIG. 1.

The cord permits the flow of a source of potential to the apparatus when coupled to an electrical outlet. The batteries supply a source of electrical potential to the apparatus when utilizing it in a location distant from an electrical outlet. In an operative orientation the circular heater coils 32 and heater coil loops 34 serve to heat a tube of caulking material 12 in order to maintain proper consistency in cold weather conditions. The apparatus is adapted to regulate heat flow through the coils to prevent overheating of caulking materials. Note FIG. 5.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved caulk container with heater coils comprising, in combination:

a tube of caulking material formed in a generally cylindrical configuration with an inboard end and an outboard end, the outboard end including a conical shaped dispensing tip having an axial aperture, the tube permitting a user to squeeze it thereby expelling caulking material through the dispensing tip and onto a desired surface;

a thermal sleeve formed in a generally cylindrical configuration with an inboard region and an outboard region, the outboard region including an end with an aperture, the sleeve being formed of heat resistent semi-rigid materials, the outboard region including a plurality of circular heater coils formed contiguously with each other, the inboard region including a plurality of heater coil loops formed in a semi-circular offset arrangement, the heater coil loops being operatively coupled to the circular heater coils, an opening being defined between the loops, the opening including VELCRO coupling means and a linear slit to permit a user to open the inboard end of the sleeve and insert a tube of caulking material therein, the tube of caulking material being securely positioned within the sleeve with its dispensing tip extending through the aperture in the outboard end of the sleeve;

a battery pack formed as a generally rectangular shaped box, the batter pack including an upper surface containing a lid to permit removal and placement of at least one battery therein, the battery pack also including a pair of male prong members and battery terminals, the male prong members and battery terminals being operatively coupled to the circular heater coils and heater coil loops of the apparatus; and an extension cord having two free ends, a first end including a female plug affixed thereto, the female plug adapted to mate with the male prong members of the battery pack in an operative orientation, a second end including a male plug affixed thereto, the male plug adapted to be positioned in a standard ground electrical outlet in an operative orientation, the cord permitting the flow of a source of potential to the apparatus when coupled to an electrical outlet, the batteries supplying a source of electrical potential to the apparatus when utilizing it in a location distant from an electrical outlet, in an operative orientation the circular heater coils and heater coil loops serving to heat a tube of caulking material in order to maintain proper consistency in cold weather conditions.

2. A caulk container with heater coils comprising:

a thermal sleeve formed in a generally cylindrical configuration with an inboard region and an outboard region, the sleeve being formed of heat-resistent material, the sleeve including a plurality of heater coils operatively coupled to each other, the sleeve measuring about ten inches in length and about two inches in diameter, the Outboard region having an end including an aperture to permit the passage of a dispensing tip of a tube of caulking material therethrough, the inboard region of the sleeve including coupling means to permit insertion of a tube of caulking material therein, the sleeve including a power source to cause thermal heating of the heater coils of the apparatus, the power source comprising a battery pack formed as a generally rectangular shaped box, the battery pack including an upper surface containing a lid to permit removal and placement of at least one battery therein, the battery pack further including a pair of male prong members and battery terminals, the male prong members and battery terminals being operatively coupled to the heater coils of the apparatus; and an extension cord having a first end and a second end, the first end being couplable to the male prong members of the battery pack, the second end being couplable to a standard ground electrical outlet.

* * * * *